US006510925B1

(12) United States Patent
De Jong

(10) Patent No.: US 6,510,925 B1
(45) Date of Patent: Jan. 28, 2003

(54) ELEVATOR GUIDE SHOE

(75) Inventor: Johannes De Jong, Järvenpää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/565,451

(22) Filed: May 5, 2000

Related U.S. Application Data

(63) Continuation of application No. PCT/FI98/00862, filed on Nov. 5, 1998.

(30) Foreign Application Priority Data

Nov. 6, 1997 (FI) ..... 974156

(51) Int. Cl.[7] ..... B66B 7/04
(52) U.S. Cl. ..... 187/409; 187/410
(58) Field of Search ..... 187/409, 410

(56) References Cited

U.S. PATENT DOCUMENTS

| | | | | |
|---|---|---|---|---|
| 1,566,490 A | * | 12/1925 | Lindquist | 187/409 |
| 2,045,620 A | * | 6/1936 | Spullies | 187/409 |
| 2,057,118 A | * | 10/1936 | Sanford | 187/409 |
| 2,308,210 A | * | 1/1943 | Sahlin | 187/409 |
| 4,865,157 A | | 9/1989 | Sissala | |
| 5,379,864 A | * | 1/1995 | Colby | 187/409 |
| 5,401,103 A | | 3/1995 | De Jong et al. | |
| 5,473,963 A | * | 12/1995 | Aeschback | |
| 5,715,914 A | | 2/1998 | Traktovenko | |

FOREIGN PATENT DOCUMENTS

| | | | |
|---|---|---|---|
| AU | 32893/84 | * of 1984 | |
| AU | B-3289384 | 5/1989 | |
| DE | 003919850 | * 12/1989 | 187/409 |
| FI | B082918 | 7/1989 | |
| JP | 5525589 | 3/1976 | |
| JP | 7196273 | 8/1995 | |

* cited by examiner

*Primary Examiner*—Robert P. Olszewski
*Assistant Examiner*—Steven B. McAllister
(74) *Attorney, Agent, or Firm*—Birch, Stewart, Kolasch & Birch, LLP

(57) ABSTRACT

Elevator guide shoe for guiding an elevator car along guide rails in an elevator shaft, said guide shoe comprising a supporting frame (2) attached to the elevator car (1) and guides (4) resting against a guide rail (3). According to the invention, the guide shoe comprises an intermediate frame (5), to which the guides (4) are attached. In addition, the supporting frame (2) and the intermediate frame (5) are provided with permanent magnet bars (6*a,* 6*b,* 7*a,* 7*b,* 8*a,* 8*b*) arranged to maintain a horizontal distance between the supporting frame and the intermediate frame. Moreover, the guide shoe comprises vertical suspension (9) between the supporting frame and the intermediate frame to damp the propagation of sound in the structures.

15 Claims, 3 Drawing Sheets

ELEVATOR GUIDE SHOE

CONTINUITY DATA

This application is a continuation of PCT/FI98/00862, filed on Nov. 5, 1998.

DESCRIPTION OF PRIOR ART

The present invention relates to an elevator guide shoe as defined in the preamble of claim 1.

A guide shoe is used in an elevator car to guide it along guide rails in an elevator shaft. The guide shoe is provided with bearing elements based on a sliding or rolling action, which rest against the guide rails. However, a car mounted with such bearings on the guide rails produces a noise when moving, which is propagated as structure-borne noise to the inside of the car. Such noise is unpleasant for the passengers and reduces the level of comfort they experience in using the elevator.

In prior art, several methods have been used to eliminate these problems. In Japanese patent specification 7196273, these problems are dealt with by using servo-controlled magnetic coils to float the car. This is a very difficult solution in respect of the control engineering system involved and therefore expensive.

Japanese patent specification 55-25589 presents an elevator which uses permanent magnets fitted in the elevator shaft and permanent magnet guides fitted close to them on the elevator car. The elevator car is supported in a floating manner based on magnetic repulsion between the permanent magnet guides and guide rails. This is a difficult and expensive solution. Moreover, the long magnetic guide rail needed in the elevator shaft in this solution attracts all sorts of rubbish.

SUMMARY OF INVENTION

The object of the present invention is to eliminate the drawbacks described above. A specific object of the present invention is to disclose a new type of guide shoe that, being simple and reliable in construction, effectively damps the sound waves generated in the guide rail and guide shoe and prevents them from being propagated to the elevator car, thus making the elevator more agreeable to use.

As for the features characteristic of the invention, reference is made to the claims.

The guide shoe of the invention comprises a supporting frame attached to the elevator car and guides resting against guide rails in the elevator shaft. The guides used may consist of various known bearing elements mainly based on a sliding or rolling action. According to the invention, the guide shoe comprises an intermediate frame to which the guides are attached, the supporting frame and the intermediate frame being provided with permanent magnets appropriately disposed oppositely to each other to maintain a horizontal distance between the supporting frame and the intermediate frame, i.e. to keep them apart so that there is no direct contact between them. Thus, the supporting frame and the intermediate frame do not touch each other in the horizontal direction but are always separated by an air gap. Moreover, according to the invention, the supporting frame and the intermediate frame are connected to each other in the vertical direction by a suspension system that damps sound waves propagating via the structures.

In a preferred embodiment of the invention, the supporting frame consists of a box open on one of its lateral sides, the intermediate frame being fitted inside the box. The intermediate frame meets the guide rail in the direction of the open side of the supporting frame. The intermediate frame may be a body of e.g. U-shaped or semicircular form, surrounding the guide rail substantially on three sides of the rail.

The vertical suspension between the supporting frame and the intermediate frame preferably consists of an elastic suspension system that permits slight movements between the intermediate frame and the supporting frame relative to each other in both horizontal and vertical directions. Further, the suspension is preferably implemented using structures or materials with a low sound transmission capability to prevent the propagation of the noise generated between the guides and the guide rail to the elevator car.

The suspension may be implemented using e.g. suitable spiral springs and suspension cables connected to them, which may additionally comprise auxiliary structures inhibiting sound propagation. The elastic suspension may also be implemented using support blocks, pillows or jackets made e.g. of cork, fitted between the supporting frame and the intermediate frame.

In an embodiment of the invention, the guide shoe is provided with a detector for measuring the displacement between the supporting frame and the intermediate frame. The displacement may be relatively large e.g. when the car has a very eccentric load, and in this case the guide shoe is preferably provided with servo-connected electromagnets, which can be used to compensate undesirable displacements between the supporting frame and the intermediate frame.

Magnets of square or circular cross-section are ill suited for bidirectional magnetic floating because they always have a considerable parasitic spring constant perpendicular to the main springing direction. This parasitic spring constant should be focused in the direction in which the movement is mechanically restricted. For this reason, the permanent magnets used are preferably magnets having an elongated cross-section such that, of the edges perpendicular to the magnetising direction, i.e. the main springing direction, the horizontal edge is considerably longer than the vertical edge. Thus, the permanent magnet used here is an elongated permanent magnet bar whose magnetic poles are located on its opposite long sides.

The suspension system preferably comprises a plurality of horizontal permanent magnet bars placed side by side and in parallel directions at a vertical distance from each other. Thus, both the intermediate frame and the supporting frame have an equal number of equally sized elongated horizontal permanent magnet bars, the oppositely placed permanent magnet bars in the supporting frame and intermediate frame forming pairs of permanent magnets repellent to each other.

Preferably both the supporting frame and the intermediate frame are provided with a ferromagnetic backing to which the permanent magnets are fixed or on which they are supported. In this way, the height of the magnets, i.e. the dimension in the main springing direction can be halved while the field remains about the same.

As to their polarities, the permanent magnet pairs are preferably so arranged that adjacent permanent magnet pairs are of opposite polarity. This provides a considerable advantage because the crosswise force with the next pair is also a repulsive force, thus increasing the spring constant instead of reducing it as it would in the case of homopolar neighbours.

The permanent magnet pairs are preferably so disposed that they form a 180° arch around the guide rail, i.e. so that the repulsive forces of the permanent magnet pairs from two opposite directions cancel each other while in the perpendicular horizontal direction between these the repulsive forces of the permanent magnet pairs press the intermediate frame against the guide rail in the elevator shaft.

The guide shoe of the invention has considerable advantages as compared with prior art. The invention provides a simple and cheap method of preventing the structure-borne noise in elevator guide rails from being transmitted to the elevator car. The elevator shaft need not be equipped with long magnetised guide rails and the structure does not necessarily require any regular adjustment. The invention makes it possible to achieve an elevator without a rigid mechanical connection between the guide rails and the elevator car, which would constitute a path for the transmission of sound waves between them. Thus, more noiseless and agreeable elevator travel is achieved.

BRIEF DESCRIPTION OF THE DRAWINGS

In the following, the invention will be described in detail by referring to the attached drawings, wherein.

DESCRIPTION OF THE PREFERRED EMBODIMENTS

Figure 1:
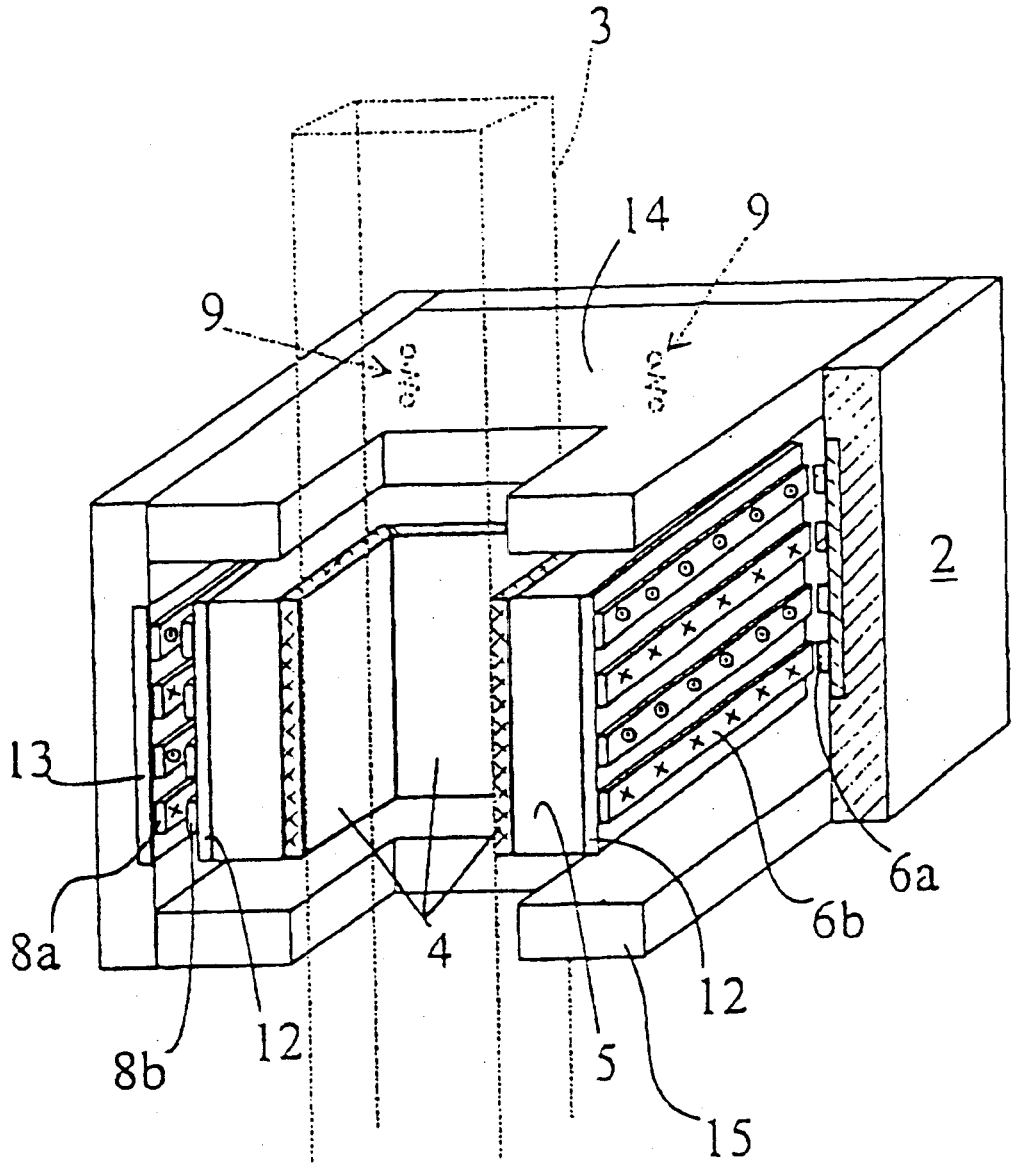
FIG. 1 presents a diagrammatic perspective view of a guide shoe according to the invention.

The same or corresponding parts in different figures are identified by the same reference numbers. The guide shoe comprises a box-like supporting frame 2 open on one side and attached to the elevator car 1. The upper 14 and lower 15 surfaces of the supporting frame are provided with slots forming a space for a guide rail 3. Placed inside the supporting frame 2 is an intermediate frame 5, which is of a shape substantially corresponding to the space inside the supporting frame and which is provided with a similar slot for the guide rail.

Disposed around the guide rail slot in the intermediate frame are guides 4, or in this embodiment sliding bearing surfaces, which lean on the guide rail 3. The intermediate frame 5 is separated by a distance from the supporting frame 2 in both vertical an d lateral directions, in other words, there is no contact in any direction between adjacent surfaces of the frames.

In the vertical direction, the intermediate frame 5 is connected to the supporting frame 2 via spring suspension elements 9 from both the and upper and lower sides of the supporting frame. These suspension elements permit slight movements of the intermediate frame relative to the supporting frame in both vertical and horizontal directions.

The three vertical outer surfaces of the intermediate frame 5 inside the supporting frame are provided with ferromagnetic plates 12 and also the corresponding inner surfaces of the supporting frame 2 are provided with similar ferromagnetic backing plates 13. Attached to these ferromagnetic backing plates are elongated permanent magnet bars 6*a* and 6*b*, 7*a* and 7*b*, 8*a* and 8*b*. The permanent magnets have an elongated cross-section so that their long planar surfaces perpendicular to the magnetising diretion in the permanent magnet pairs lie opposite to each other. Moreover, a plurality of permanent magnet pairs are placed side by side in the vertical direction in such manner that the magnetising directions in adjacent permanent magnet pairs are reverse to each other, in other words, of any two adjacent permanent magnet pairs, one pair has the S-poles opposite each other and the other pair has the N-poles opposite each other.

Figure 2:
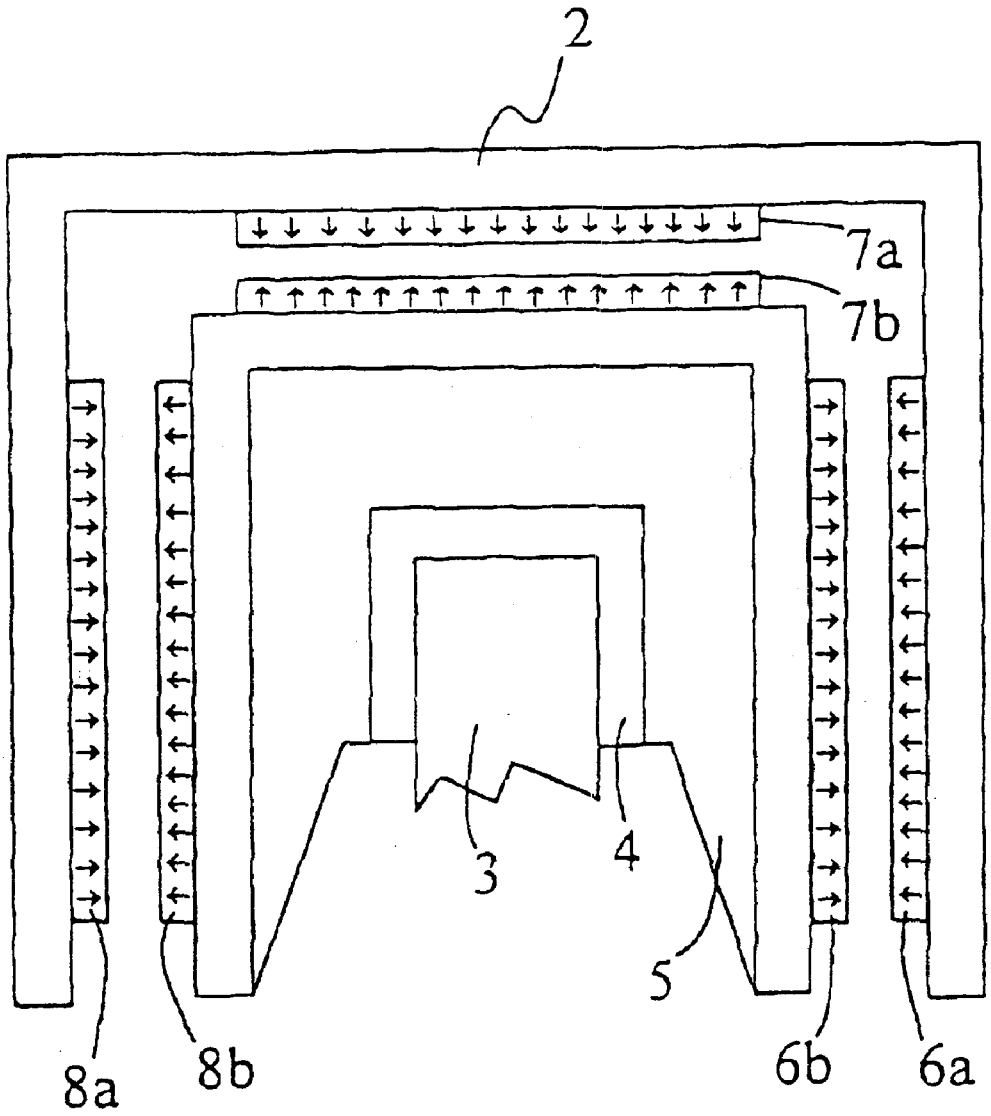
FIG. 2 presents a horizontal cross-section of a guide shoe substantially consistent with FIG. 1.

As shown in FIG. 2, in this angular U-shaped embodiment, the permanent magnets are disposed on all three sides across their entire widths. Permanent magnet pair 6*a*, 6*b* has a repulsive force equal to that of permanent magnet pair 8*a*, 8*b*, so that these repulsive forces cancel each other and keep the intermediate frame in place around the guide rail 3. Unlike these, permanent magnet pair 7*a*, 7*b* generates a repulsive force that presses the intermediate frame against the guide rail 3. This force is received by the guide rail 3 via a sliding bearing 4 and thus the guide shoe remains accurately in position, pressed against the guide rail 3.

Figure 3:
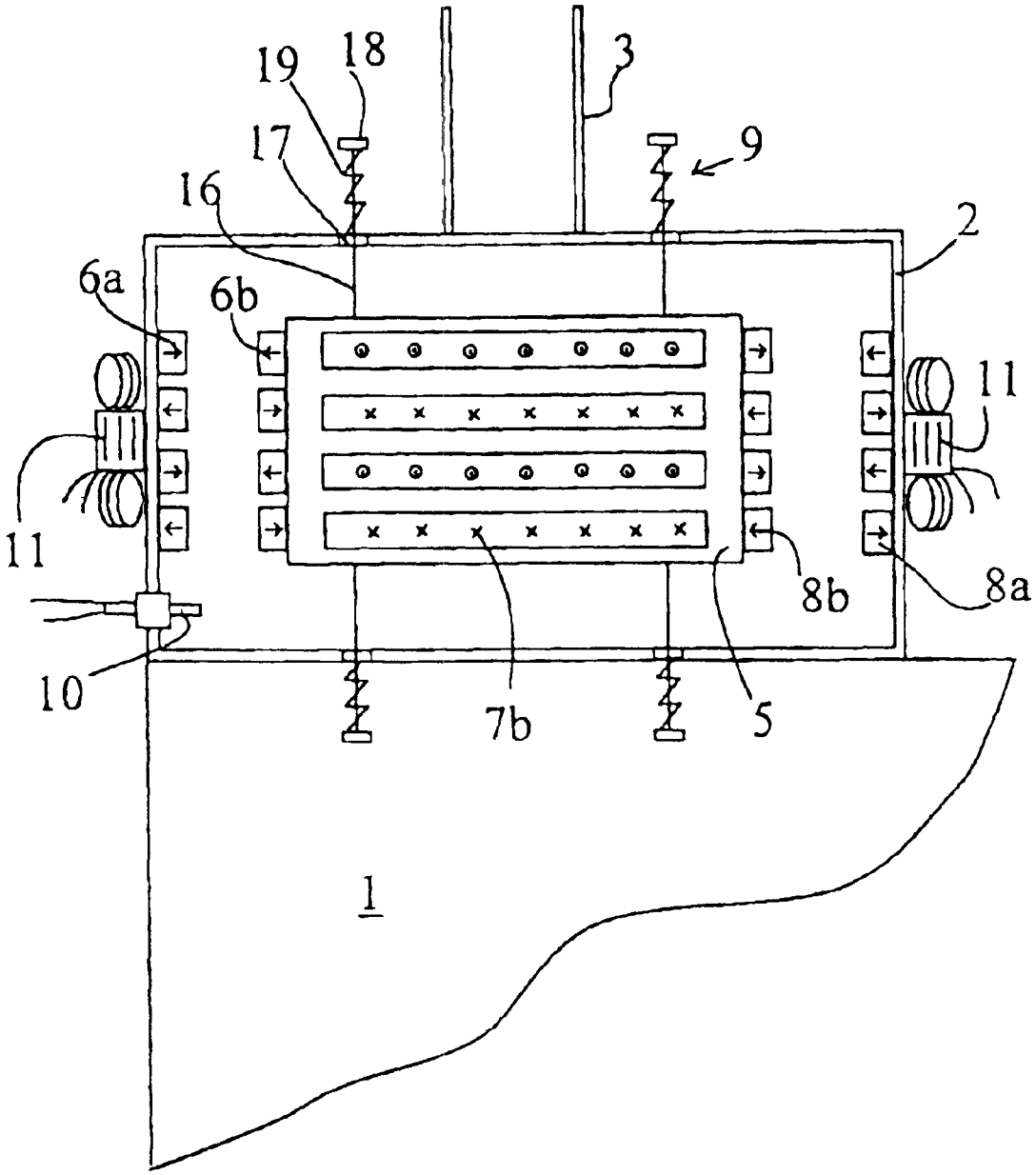
FIG. 3 presents a partially open side view of a guide shoe according to the invention.

FIG. 3 is a more detailed illustration of a suspension system 9 according to the invention. In this embodiment, the suspension between the supporting frame 2 and the intermediate frame 5 consists of a cable 16 which goes through a hole 17 in the supporting frame 2 to an auxiliary block 18 placed at a distance outside the supporting frame 2. The auxiliary block 18 is supported in position by a spring 19 attached to the supporting frame 2. Moreover, the auxiliary block 18 can be made of a material having a good sound damping property. The intermediate frame 5 is suspended on the supporting frame 2 in this manner by four different points. Thus, the elastic suspension permits the intermediate frame to move slightly with respect to the supporting frame 2 in both vertical and horizontal directions while still preventing direct contacts between the intermediate frame and the supporting frame. Therefore, sound waves generated by the motion between the intermediate frame and the guide rail 3 can not be transmitted to a significant degree as structure-borne noise to the elevator car.

In addition, in the embodiment in FIG. 2, the supporting frame 2 comprises a detector 10, which is used to measure or monitor the position of the intermediate frame 5 in relation to the supporting frame 2. Moreover, the supporting frame 2 is provided with electromagnets 11, and if the intermediate frame 5 is displaced e.g. due to an imbalance of the car load so that it comes too close to the supporting frame, the situation can be corrected by means of the electromagnets 11. The electromagnets 11 can also be used to damp any swinging motion of the elevator car.

In the foregoing, the invention has been described by way of example by the aid of the attached drawings, but different embodiments of the invention are possible within the scope of the inventive idea defined by the claims.

What is claimed is:

1. An elevator guide shoe for guiding an elevator car along a guide rail in an elevator shaft, said guide shoe comprising:

a support frame for attachment to the elevator car;

a first plurality of permanent magnets attached to said support frame;

an intermediate frame;

a second plurality of magnets attached to said intermediate frame, wherein said second plurality of magnets face to like poles of said first plurality of magnets, such that a magnetic force Acts in a First plane and tends to create a horizontal spacing between said support frame and said intermediate frame;

guides attached to said intermediate frame, said guides for engaging the guide rail; and a suspension system located between said support frame and said intermediate frame, said suspension system allowing translational movement of the intermediate frame relative to the support frame in a second plane different from the first plane tending to create a vertical spacing between said support frame and said intermediate frame.

2. The elevator guide shoe according to claim 1, wherein said support frame is substantially box-shaped with an open lateral side, and wherein said intermediate frame is located inside said support frame.

3. The elevator guide shoe according to claim 1, wherein said intermediate frame is substantially unshaped, and wherein said intermediate frame is capable of surrounding three sides of the guide rail.

4. The elevator guide shoe according to claim 3, wherein said second plurality of magnets are located on three sides of said u-shaped intermediate frame.

5. The elevator guide shoe according to claim 1, wherein said suspension system includes an elastic element which permits slight movement of the said intermediate frame relative to said support frame in both the horizontal and vertical directions.

6. The elevator guide shoe according to claim 5, wherein said suspension system has a low sound transmission attribute to attenuate a transmission of sound from the intermediate frame to the supporting frame.

7. The elevator guide shoe according to claim 1, further comprising:

a distance detector detecting a spacing between said supporting frame and said intermediate frame.

8. The elevator guide shoe according to claim 1, further comprising:

an electromagnet adjacent to said supporting frame, said electro-magnet being capable of generating a magnetic force to act in coordination with a magnetic force produced by said first plurality of magnets.

9. The elevator guide shoe according to claim 1, wherein said first and second plurality of magnets include elongated permanent-magnet bars having poles located on opposing elongated side faces.

10. The elevator guide shoe according to claim 1, wherein said first plurality of magnets includes a plurality of first elongated permanent-magnet bars having poles located on opposing elongated side faces, wherein said plurality of first elongated permanent-magnet bars are placed side by side in parallel directions on said support frame, with a vertical spacing between adjacent first elongated permanent magnet bars, and wherein said second plurality of magnets includes a plurality of second elongated permanent-magnet bars having poles located on opposing elongated side faces, wherein said plurality of second elongated permanent-magnet bars are placed side by side in parallel directions on said intermediate frame, with a vertical spacing between adjacent second elongated permanent magnet bars.

11. The elevator guide shoe according to claim 10, wherein adjacent pairs of said first elongated permanent-magnet bars present opposite magnetic polarities toward said intermediate frame; and wherein adjacent pairs of said second elongated permanent-magnet bars present opposite magnetic polarities toward said support frame.

12. The elevator guide shoe according to claim 1, further comprising:

a first ferromagnetic backing located between said first plurality of magnets and said support frame; and a second ferromagnetic backing located between said second plurality of magnets and said support surface.

13. The elevator guide shoe according to claim 2, wherein said suspension system includes a first suspension element located between a top side of said box-shaped support frame and a top side of said intermediate frame.

14. The elevator guide shoe according to claim 13, wherein said suspension system further includes a second suspension element located between a bottom side of said box-shaped support frame and a bottom side of said intermediate frame.

15. The elevator guide shoe according to claim 14, wherein said first and second suspension elements include first and second springs, respectively.

* * * * *